US006110014A

United States Patent [19]

Suzuki

[11] Patent Number: 6,110,014

[45] Date of Patent: Aug. 29, 2000

[54] METHOD AND APPARATUS POLISHING WAFER FOR EXTENDED EFFECTIVE AREA OF WAFER

[75] Inventor: Mieko Suzuki, Tokyo, Japan

[73] Assignee: NEC Corporation, Tokyo, Japan

[21] Appl. No.: 09/193,368

[22] Filed: Nov. 17, 1998

[30] Foreign Application Priority Data

Nov. 20, 1997 [JP] Japan ..... 9-319475

[51] Int. Cl.[7] ..... B24B 1/00; B24B 29/02

[52] U.S. Cl. ..... 451/41; 59/63; 59/288; 59/290; 59/398

[58] Field of Search ..... 451/41, 59, 63, 451/785, 286, 287, 288, 290, 385, 398

[56] References Cited

U.S. PATENT DOCUMENTS

| | | | |
|---|---|---|---|
| 5,584,751 | 12/1996 | Kobayashi et al. | 451/288 |
| 5,643,053 | 7/1997 | Shendon | 451/28 |
| 5,643,061 | 7/1997 | Jackson et al. | 451/289 |
| 5,664,988 | 9/1997 | Stroupe et al. | 451/41 |
| 5,762,539 | 6/1998 | Nakashiba et al. | 451/41 |
| 5,820,448 | 10/1998 | Shamouilian et al. | 451/287 |
| 5,851,140 | 12/1998 | Barns et al. | 451/288 |
| 5,876,273 | 3/1999 | Yano et al. | 451/288 |
| 5,916,015 | 6/1999 | Natalicio | 451/288 |
| 5,931,725 | 8/1999 | Inaba et al. | 451/288 |

FOREIGN PATENT DOCUMENTS

| | | |
|---|---|---|
| 5-326468 | 12/1993 | Japan . |
| 8-229804 | 9/1996 | Japan . |
| 9-139366 | 5/1997 | Japan . |

*Primary Examiner*—Timothy V. Eley

[57] ABSTRACT

A wafer polishing apparatus includes a carrier and a table. A wafer is mounted on the carrier, and the carrier includes a circumference ring provided around of the wafer. The height of the innermost portion of the circumference ring is equal to or higher than that of a surface of the wafer. The table includes a polishing pad. The carrier and the table are relatively rotated such that the wafer surface is polished by the polishing pad.

16 Claims, 5 Drawing Sheets

METHOD AND APPARATUS POLISHING WAFER FOR EXTENDED EFFECTIVE AREA OF WAFER

BACKGROUND OF THE INVENTION

1. Field of the Invention

The present invention relates to a method and apparatus for polishing a wafer, and more particularly to a method for polishing a wafer for an extended effective area of the wafer, and an apparatus for the same.

2. Description of the Related Art

As a method for polishing a wafer is known the technique described in, For example, Japanese Laid Open Patent Application (JP-A-Heisei 5-326468). In the above conventional example, as shown in FIGS. 1A and 1B, the circumference ring 35, which is thinner than the thickness of a wafer 36, is provided around the wafer 36. The wafer 36 surrounded by the circumference ring 35 is mounted on a carrier 31, and the carrier 31 is pushed to a polishing pad section 32 which is mounted on a polishing table 33, while the carrier 31 and the polishing table 33 are rotated. As a result, the wafer 36 is polished.

In the above conventional example, the wafer 36 is pushed to the polishing pad section 32. Therefore, in case of polishing, a great load is imposed on a peripheral portion of the wafer 36, because the wafer 36 protrudes out of the circumference ring 35. As a result, the polishing rate becomes large in the peripheral portion of the wafer, so that uniformity of the wafer surface is not obtained.

SUMMARY OF THE INVENTION

The present invention is accomplished to solve the above problems. Therefore, an object of the present invention is to provide a method of polishing a wafer in which the effective area of a wafer can be extended while keeping uniformity.

In order to achieve an aspect of the present invention, a wafer polishing apparatus includes a carrier on which a wafer is mounted, and a table including a polishing pad. The carrier includes a circumference ring provided around of the wafer, and a height of the innermost portion of the circumference ring is equal to or higher than that of a surface of the wafer. The carrier and the table are relatively rotated such that the wafer surface is polished by the polishing pad.

The circumference ring may have a surface parallel to the wafer surface. In this case, it is desirable that a thickness of the protruding portion of the circumference ring from the wafer surface is in a range of 1/10 to 1 of a thickness width of the wafer.

Also, the circumference ring may have an inclined surface to the wafer surface, and a thickness of the circumference ring in an inner portion may be smaller than that of the circumference ring in an outer portion. In this case, the circumference ring has the inclined surface with an angle in a range of 0.0005 to 0.005 radians.

Also, the polishing pad may be provided on the table via a flexible plate. In this case, the flexible plate is an air plate.

In order to achieve another aspect of the present invention, a wafer polishing apparatus includes a carrier on which a wafer is mounted, and a table including a polishing pad. The carrier includes a circumference ring provided around of the wafer and having an inclined surface, and a height of the innermost portion of the circumference ring is equal to or higher than that of a surface of the wafer. The carrier and the table are relatively rotated such that the wafer surface is polished by the polishing pad.

In order to achieve still another aspect of the present invention, a method of polishing a wafer includes the steps of:

mounting a wafer in a state in which the wafer is located in a circumference ring of a carrier, a height of the innermost portion of the circumference ring being equal to or higher than that of a surface of the wafer; and relatively rotating the carrier and the table such that the wafer surface is polished by a polishing pad which is mounted on the table.

DESCRIPTION OF THE PREFERRED EMBODIMENTS

The wafer polishing apparatus of the present invention will be described below in detail with reference to the attached drawings.

Figure 3A:
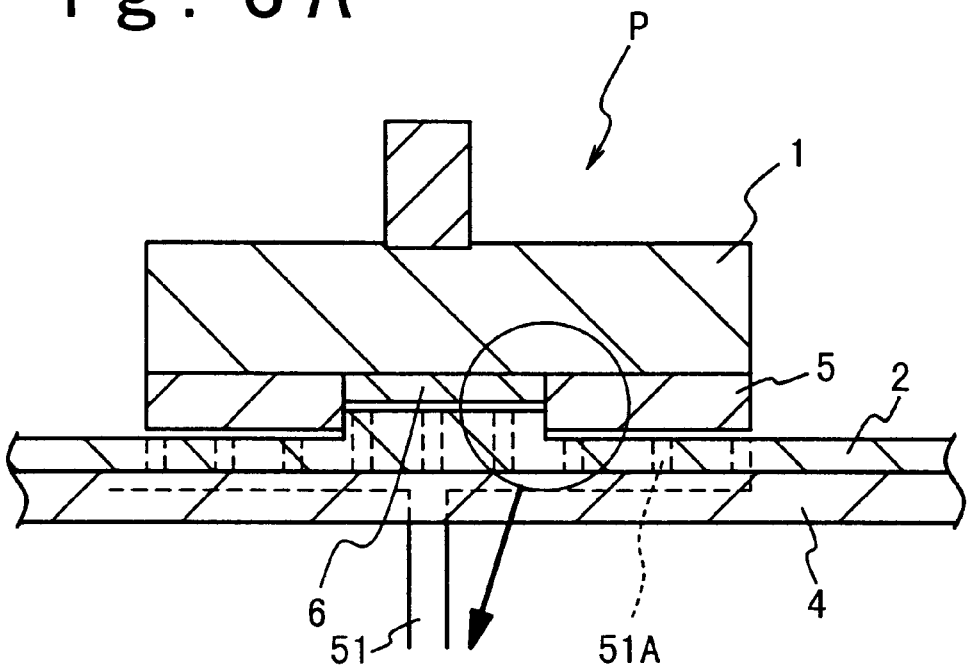
FIG. 3A is a diagram showing a wafer polishing apparatus according to a first embodiment of the present invention.
Figure 3B:
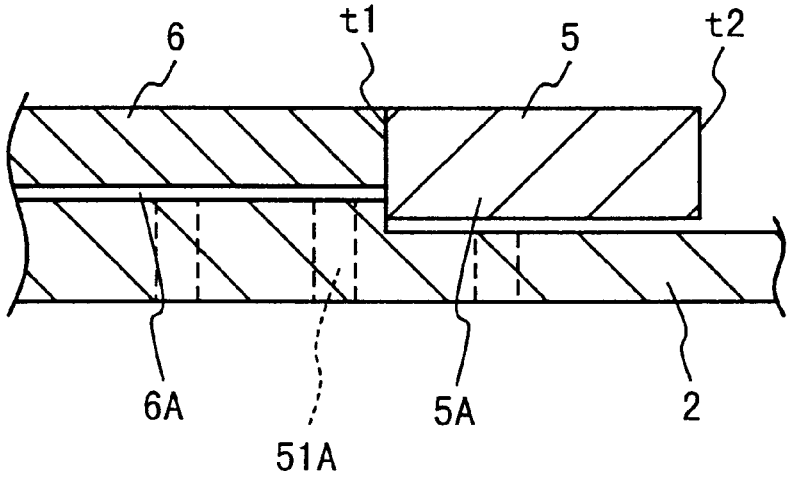
FIG. 3B is an expanded diagram illustrating the peripheral portion of a wafer shown in FIG. 3A.

FIG. 3A shows the structure of the wafer polishing apparatus according to the first embodiment of the present invention. FIG. 3B is an expanded view of a circled portion of FIG. 3A. In FIG. 3A, a semiconductor wafer 6 is mounted on a carrier 1, and a circumference ring 5 is provided around of the wafer 6. The circumference ring 5 has a surface parallel to the wafer 6 and the carrier 1, and thickness t2 of the circumference ring 5 is thicker than the thickness t1 of the polished wafer 1. Also, a polishing pad section 2 which is composed of a hard plate and a polishing pad mounted on the hard plate. The polishing pad section 2 is fixedly attached on a table 4. The carrier 1 with the wafer 6 is pushed to the polishing pad section 2 while the carrier 1 is rotated. At that time, because the circumference ring 5 protrudes from the wafer 6, the polishing pad is pushed. Therefore, there is no case that the peripheral portion of the wafer 6 is especially strongly polished. Also, slurry as polishing agent is supplied through a pipe 51 and small holes 51A.

In the above description, the polishing pad is rotated. However, the carrier 1 and the polishing pad section 2 or the table 4 may be relatively rotated. Thus, the wafer 6 surface is polished.

Next, a wafer polishing method using the above wafer polishing apparatus will be described below with reference to FIGS. 2A to 2C.

Figure 1A:
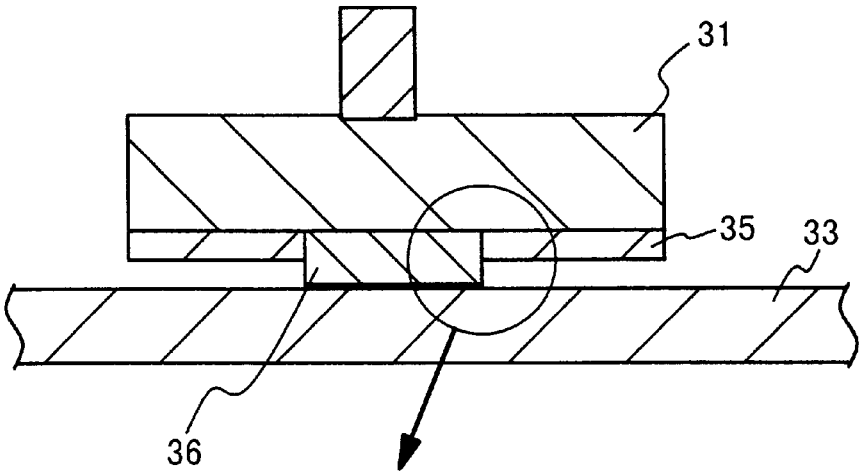
Fig. 1A PRIOR ART
FIG. 1A is a diagram showing a conventional example of a wafer polishing apparatus.
Figure 1B:
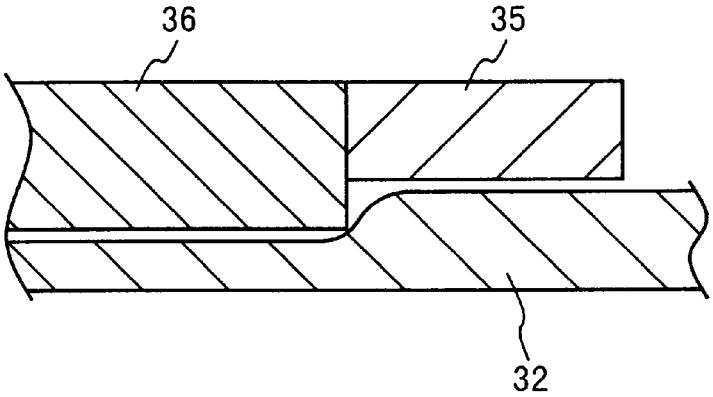
Fig. 1B PRIOR ART
FIG. 1B is an expanded diagram illustrating the peripheral portion of a wafer shown in FIG. 1A.
Figure 2A:
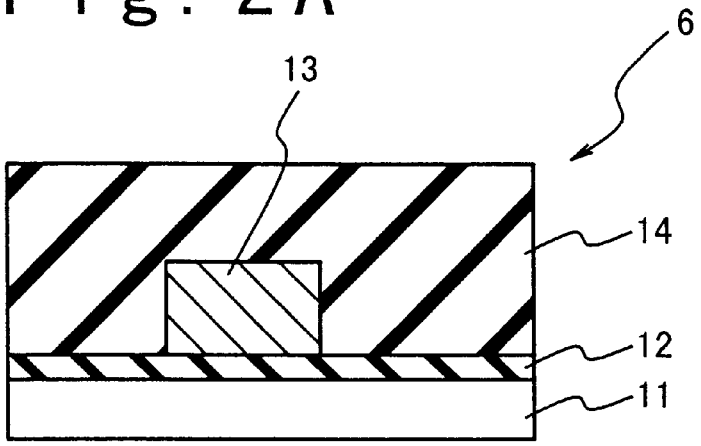
FIGS. 2A to 2C are cross sectional views of a semiconductor device when a wafer polishing method of the present invention is performed.

In the first embodiment, as shown in FIG. 2A, a first interlayer insulating film 14 is formed on a semiconductor substrate 11 having a first metal wiring 13 in the semiconductor wafer 6. The semiconductor wafer 6 is mounted on the carrier 1. The circumference ring 5 is mounted on the carrier 1 to have a surface 5A protruding than the semiconductor wafer 6 surface 6A. Using such a wafer polishing apparatus P shown in FIG. 3A and silica particle as the slurry, the interlayer insulating film 14 is flattened by a chemical mechanical polishing (hereinafter to be referred to as a CMP) method.

Figure 2B:
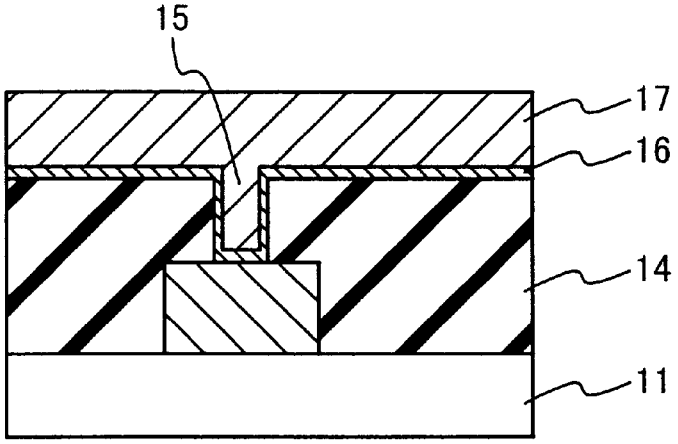

Next, as shown in FIG. 2B, a via-hole 15 is formed and then a titanium nitride film 16 is formed as a fitting layer. After that, a tungsten film 17 is formed over the semiconductor wafer surface.

Figure 2C:
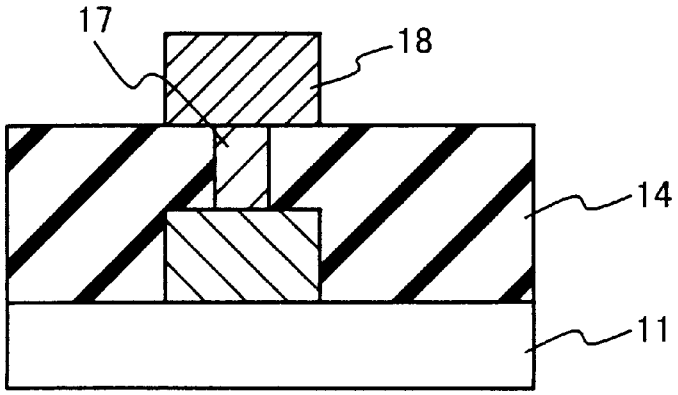

Next, as shown in FIG. 2C, using the wafer polishing apparatus P of the present invention and the slurry of alumina particles, the tungsten film 7 and the titanium nitride film 6 are polished to form a tungsten plug. Then, a metal layer 18 is formed.

More specifically, a first interlayer insulating film 14 with the film thickness of 10000 Å is formed on semiconductor substrate 11 on which a first metal wiring 13 has been formed to have the film thickness of 5000 Å (FIG. 2A). Silica particles with the concentration of 10 wt % is used as the slurry. The slurry is supplied through the pipe 51 and the table 4 to the polishing surface. Also, the wafer polishing apparatus P is used. The wafer polishing apparatus P has the circumference ring 5 which protrudes from the semiconductor wafer surfaces 6A by ⅓ of the thickness of the wafer 6. Thus, the flattening of the semiconductor wafer surface 6A is performed by the CMP method. After that, a via-hole 15 is opened and then the titanium nitride film 16 is formed over the whole surface to have the film thickness of 500 Å as the fitting layer. Subsequently, the tungsten film 17 is formed on the whole surface of the titanium nitride film to have the film thickness of 5000 Å (FIG. 2B).

Next, using the slurry in which $KIO_3$ as oxidant is added into alumina particles with concentration of 5 wt %, and the wafer polishing apparatus P, the tungsten film 17 and the titanium nitride film 16 are complete polished. Then, the titanium nitride film with the film thickness of 500 Å and an Al—Cu film with the film thickness of 4500 Å are continuously sputtered to form a second metal wiring 8, as shown in FIG. 2C.

In the above description, the circumference ring 5 protrudes from the wafer 6 surface by ⅓ of the wafer 6 thickness. However, when the protruding thickness is in a range of 1/10 to 1 of the wafer 6 thickness, the similar effect can be obtained.

Also, $KIO_3$ is used as the oxidant to alumina particles. However, even when Fe system oxidant such as iron (II) nitride is used, the similar effect can be obtained.

The polishing condition of the CMP method is as follows:

the number of rotations of table: 10 to 70 rpm;

the number of rotations of carrier: 10 to 70 rpm;

load: 2 to 8 psi;

back loads: 0 to 4 psi; and slurry flow rate: 50 to 200 cc/min.

Next, the wafer polishing apparatus according to the second embodiment of the present invention will be described with reference to FIGS. 4A and 4B.

Figure 4A:
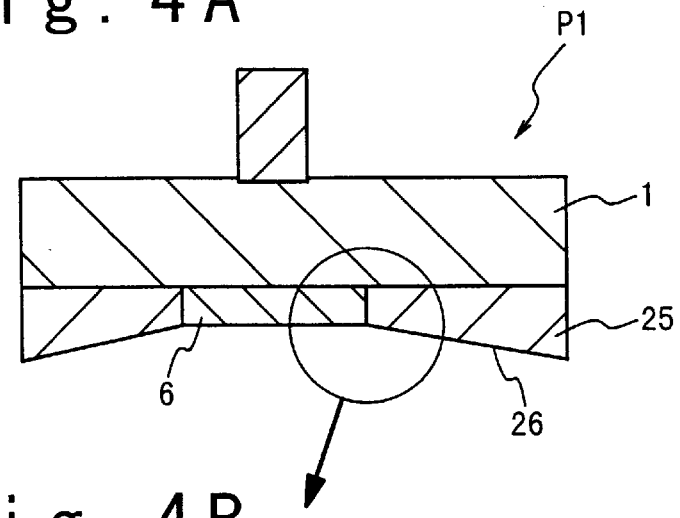
FIG. 4A is a diagram showing a carrier of the wafer polishing apparatus according to a second embodiment of the present invention.
Figure 4B:
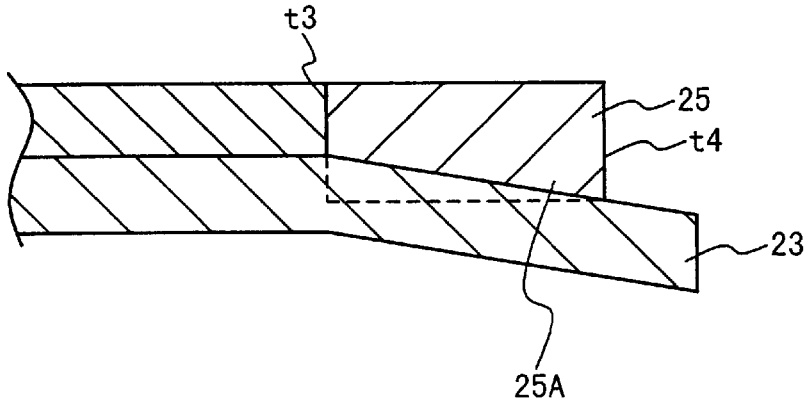
FIG. 4B is an expanded diagram illustrating the peripheral portion of a wafer shown in FIG. 4A.
Figure 5:
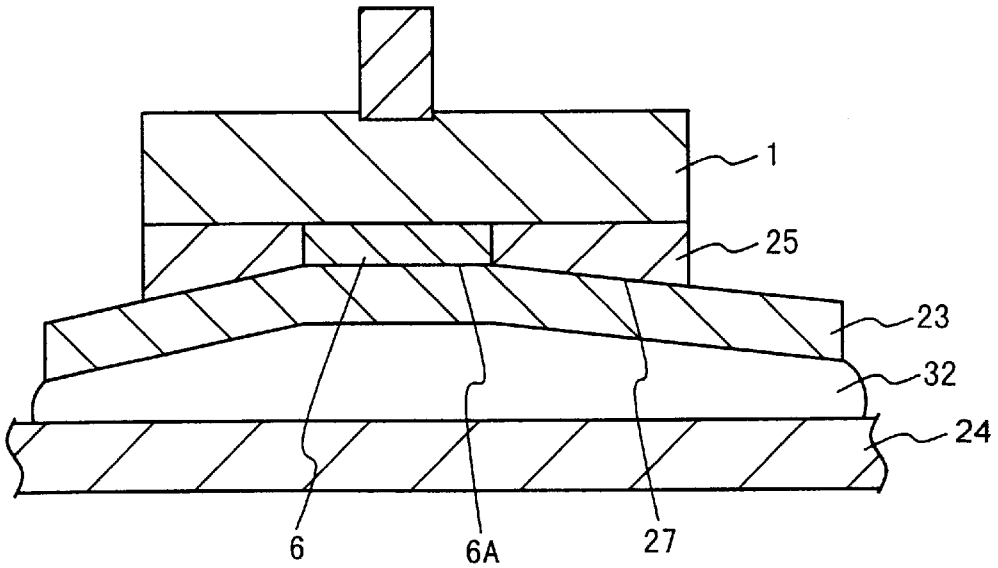
FIG. 5 is a diagram showing the state in which a wafer is polished using the wafer polishing apparatus in the second embodiment.

Referring to FIG. 4A, the wafer 6 is mounted on the carrier 1 with a circumference ring 25. The circumference ring 25 has the thickness t3 in the inner circumference and the thickness t4 (>or=t3) in the outer circumference, as shown in FIG. 4B. The thickness t3 of the circumference ring 25 is equal to or larger than the thickness of the wafer 6. Thus, an inclined surface to the carrier 1 surface or the wafer surface 6A is formed on the circumference ring 25. The carrier 1 is pushed to the polishing pad section which is attached on the table, and the CMP method is performed in this state. As shown in FIG. 5, the polishing pad section is composed of the polishing pad 23 and a flexible plate 32 such as an air plate. The flexible plate 32 is mounted on the table 4. Thus, the surface of the polishing pad 23 can be fit to the wafer surface 6A.

In the second embodiment, the first interlayer insulating film 14 is formed on the semiconductor substrate 11 having the first metal wiring 13 in the semiconductor wafer 6. The semiconductor wafer 6 is mounted on the carrier 1 on which the circumference ring 25 is mounted to have a protruding section with an inclined surface 25A from the semiconductor wafer 6 surface 6A. Using such a wafer polishing apparatus P and silica particle as slurry, the interlayer insulating film 14 is flattened by a chemical mechanical polishing (hereinafter to be referred to as a CMP) method.

In this case, the circumference ring 25 surrounding the wafer 6 has the thickness of t3 in the inner circumference and the thickness of t4 in the outer circumference, and has the inclined surface of the 0.001 radians to the wafer 6 surface. Also, the polishing pad 23 is mounted on the flexible air plate 24 which is mounted on the table 4.

Next, the via-hole 15 is formed and then a titanium nitride film 16 is formed as the fitting layer. After that, the tungsten film 17 is formed over the semiconductor wafer surface 6A.

Next, using the wafer polishing apparatus P of the present invention and the slurry of alumina particle, the tungsten film 7 and the titanium nitride film 6 are polished to form the tungsten plug.

In the above description, the circumference ring 25 has the inclined surface of 0.001 radians to the wafer surface 6A. However, the similar effect is obtained when the inclined angle is in a range of 0.0005 to 0.005 radians.

The surface of the polishing pad 23 which is mounted on the plate such as the flexible air plate fits to the wafer surface 6A and the surface of the circumference ring 25 of the present invention. Therefore, the uniformity of the polished wafer surface 6A can be improved.

Figure 6:
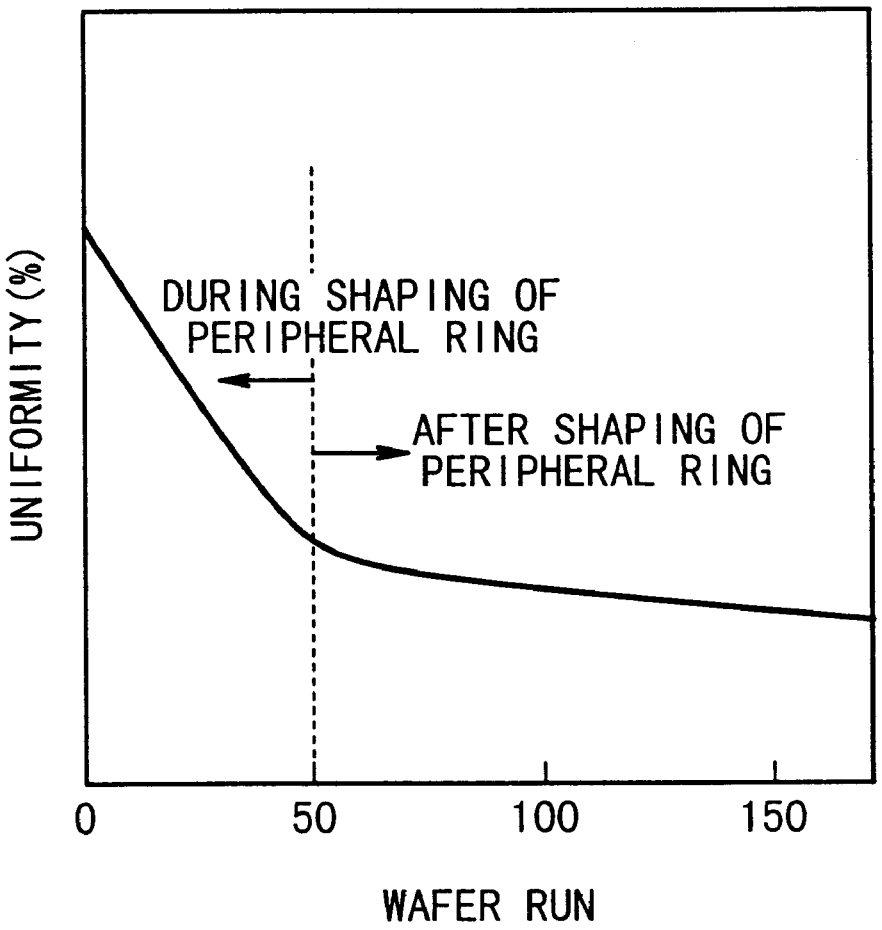
FIG. 6 is a graph illustrating the effect of the present invention.

FIG. 6 shows the change of the uniformity in case that the polishing is continuously performed. As shown in FIG. 6, 50 or more dummy wafers must be polished until uniformity becomes stable when a conventional flexible polishing pad is used. However, when the circumference ring of the present invention is used, the polishing of the dummy wafers becomes unnecessary.

As described above, according to the present invention, the circumference ring protrudes from the wafer. Thus, the polishing rate in the peripheral portion of the wafer is restrained, so that a wafer effective area can be extended.

Also, the polishing pad is mounted on the plate such as the flexible air plate, and the circumference ring has the inclined surface. In this case, the thickness of the circumference ring in the outer circumference is larger than that of the inner circumference. Thus, the polishing pad can be deformed to fit to the wafer surface. Therefore, the polish rate in the peripheral portion of the wafer can be restrained. As a result, the effective area of wafer can be extended.

What is claimed is:

1. A wafer polishing apparatus comprising:

a carrier having a wafer mounted on said carrier, wherein said carrier includes a circumference ring provided around of said wafer, and a height of an innermost portion of said circumference ring is equal to or higher than that of a height of said wafer; and a table including a polishing pad, and wherein said carrier and said table are relatively rotated such that said wafer surface is polished by said polishing pad and said circumference ring has an inclined surface to a wafer surface, said incline is at any angle of 0.0005 to 0.005 radians to said wafer surface.

2. A wafer polishing apparatus according to claim 1, wherein said circumference ring has a surface parallel to said wafer surface.

3. A wafer polishing apparatus according to claim 2, wherein a thickness of a protruding portion of said circumference ring from said wafer surface is in a range of 1/10 to 1 of a thickness of said wafer.

4. A wafer polishing apparatus according to claim 1, wherein said circumference ring in an inner portion is smaller than that of said circumference ring in an outer portion.

5. A wafer polishing apparatus according to claim 1, wherein said polishing pad is provided on said table via a flexible plate.

6. A wafer polishing apparatus according to claim 5, wherein said flexible plate is an air plate.

7. A wafer polishing apparatus comprising:

a carrier having a wafer mounted on said carrier, where said carrier includes a circumference ring provided around of said wafer and having an inclined surface, and a height of an innermost portion of said circumference ring is equal to or higher than that of a height of said wafer; and a table including a polishing pad, and wherein said carrier and said table are relatively rotated such that said wafer surface is polished by said polishing pad and said circumference ring has an inclined surface to a wafer surface, said incline is at an angle of 0.0005 to 0.005 radians to said wafer surface.

8. A wafer polishing apparatus according to claim 7, wherein a thickness of said circumference ring in an inner portion is smaller than that of said circumference ring in an outer portion.

9. A wafer polishing apparatus according to claim 7, wherein said polishing pad is provided on said table via a flexible plate.

10. A wafer polishing apparatus according to claim 9, wherein said flexible plate is an air plate.

11. A method of polishing a wafer comprising the steps of:

mounting a wafer in a state in which said wafer is located in a circumference ring of a carrier, a height of an innermost portion of said circumference ring being equal to or higher than that of a height of said wafer said circumference ring has an inclined surface to a wafer surface, said incline is at an angle of 0.0005 to 0.005 radians to said wafer surface; and relatively rotating said carrier and said table such that said wafer surface is polished by a polishing pad having a plurality of polishing contacts which is mounted on said table.

12. A method according to claim 11, wherein said circumference ring has a surface parallel to said wafer surface and protruding from said wafer surface such that said polishing pad is pushed during polishing.

13. A method according to claim 12, wherein a thickness of a protruding portion of said circumference ring from said wafer surface is in a range of 1/10 to 1 of a thickness of said wafer.

14. A method according to claim 11, wherein said inclined surface to said wafer surface is such that said plurality of polishing pad contacts contact said wafer with substantially the same pressure at each contact of said plurality of polishing contacts, and a thickness of said circumference ring in an inner portion is smaller than that of said circumference ring in an outer portion.

15. A method according to claim 14, wherein said polishing pad is provided on said table via a flexible plate.

16. A method according to claim 15, wherein said flexible plate is an air plate.

* * * * *